US011343618B2

(12) United States Patent
Fichtl

(10) Patent No.: US 11,343,618 B2
(45) Date of Patent: May 24, 2022

(54) INTELLIGENT, ONLINE HEARING DEVICE PERFORMANCE MANAGEMENT

(71) Applicant: SONOVA AG, Staefa (CH)

(72) Inventor: Elmar Fichtl, Hombrechtikon (CH)

(73) Assignee: Sonova AG, Staefa (CH)

( * ) Notice: Subject to any disclaimer, the term of this patent is extended or adjusted under 35 U.S.C. 154(b) by 0 days.

(21) Appl. No.: 16/772,655

(22) PCT Filed: Dec. 20, 2017

(86) PCT No.: PCT/EP2017/083874
§ 371 (c)(1),
(2) Date: Jun. 12, 2020

(87) PCT Pub. No.: WO2019/120521
PCT Pub. Date: Jun. 27, 2019

(65) Prior Publication Data

US 2021/0092534 A1 Mar. 25, 2021

(51) Int. Cl.
*H04R 25/00* (2006.01)
*G10L 25/51* (2013.01)

(52) U.S. Cl.
CPC ..... *H04R 25/505* (2013.01); *G10L 25/51* (2013.01); *H04R 25/558* (2013.01); *H04R 25/603* (2019.05); *H04R 2225/41* (2013.01); *H04R 2225/55* (2013.01); *H04R 2460/07* (2013.01)

(58) Field of Classification Search
CPC .. H04R 25/505; H04R 25/603; H04R 25/558; H04R 2225/41; H04R 2225/55; H04R 2460/07; G10L 25/51
See application file for complete search history.

(56) References Cited

U.S. PATENT DOCUMENTS

| | | | |
|---|---|---|---|
| 7,889,879 | B2 | 2/2011 | Dillon et al. |
| 2004/0213424 | A1 | 10/2004 | Hamacher |
| 2010/0202637 | A1 | 8/2010 | Cornelisse |
| 2016/0249144 | A1 | 8/2016 | Reinlein |

FOREIGN PATENT DOCUMENTS

| | | |
|---|---|---|
| EP | 2884766 | 6/2015 |

OTHER PUBLICATIONS

International Search Report and Written Opinion received in International Application No. PCT/EP2017/083874.

*Primary Examiner* — Mark Fischer
(74) *Attorney, Agent, or Firm* — ALG Intellectual Property, LLC

(57) ABSTRACT

A hearing device with online (real-time) intelligent performance management. The online management component of the hearing device learns a hearing device user's preferences for operation of the hearing device while the user is using the hearing device in every-day life. The online management component learns the user's preferences from the user's perception of the hearing device output in different listening environments and/or during different activities. The users perception include positive/satisfactory responses of the user to the output from the hearing device. The online management component builds up an individualized model for the user based upon the users perceptions whilst encountering different listening environments and/or engaging in different activities. The individualized model is used to control the hearing device to produce an acoustic output for the user.

16 Claims, 3 Drawing Sheets

INTELLIGENT, ONLINE HEARING DEVICE PERFORMANCE MANAGEMENT

BACKGROUND

Embodiments of the present disclosure relate to hearing devices and intelligent performance management of such hearing devices. More particularly, but not by way of limitation, embodiments of the present application provide for intelligent hearing device performance management using a psychoacoustic model derived from a hearing device user's preferences with respect to hearing device operation.

A hearing device may be used to improve the hearing capability or communication capability of a user, for instance by compensating a hearing loss of a hearing-impaired user, in which case the communication device is commonly referred to as a hearing instrument, such as a hearing aid, or hearing prosthesis. A hearing device may also be used to produce a sound in a user's ear canal. For example, sound may be communicated by a wire or wirelessly to a hearing device, which may reproduce the sound in the user's ear canal. For example, earbuds, earphones and/or the like may be used to generate sound in a person's ear canal.

Hearing devices are generally small and complex devices. Hearing devices can include a processor, microphone, speaker, memory, housing, and other electronical and mechanical components. Some example hearing devices are Behind-The-Ear ("BTE"), Receiver-in-Canal ("RIC"), In-The-Ear ("ITE"), Completely-In-Canal ("CIC"), and Invisible-In-The-Canal ("IIC") devices. A user can prefer one of these hearing devices compared to another device based on hearing loss, aesthetic preferences, lifestyle needs, and budget. Hearing devices are often very small so that at least a part of the hearing device can be inserted into a user's ear canal to provide for reproduction of sound proximal to the user's eardrum.

As hearing device technology develops, users prefer hearing devices with more functionality. For example, users want hearing devices that are configured to communicate wirelessly. Wireless communication improves a user's experience and enables the user to access a network or other devices with their hearing device. Additionally, users want hearing devices that have a long battery life (e.g., several days or even weeks) and that need little/infrequent maintenance.

In many instances, the hearing device uses a microphone to pick up/receive sound. Circuitry in the hearing instrument can process signals from the microphone, and provide the processed sound signal into the ear canal of the user via a miniature loudspeaker, commonly referred to as a sound reproduction device or a receiver. As noted previously, some hearing devices may receive sound signals from alternative input sources, such as an induction coil and/or a wireless transmitter, for example via a mobile phone, wireless streaming, Bluetooth connection and/or the like, and process these sounds signals and deliver them to the user.

In-the-ear (ITE) hearing devices are designed so that at least a part of the hearing device housing is inserted within a hearing device user's ear canal. In the ITE hearing device, the receiver is disposed within a hearing device housing and the acoustic output from the receiver is delivered into the user's ear canal via a sound conduit. The sound conduit may comprise a receiver port through which acoustic signals from the receiver pass into the sound conduit and a sound opening through which acoustic signals pass out of the sound conduit into the ear canal.

Sound signals picked up by the hearing device's microphone(s) are processed by a controller/signal processor that is connected between the microphone and the receiver. The controller/signal processor may comprise a processor, computer, software and/or the like. In general, the controller/signal processor amplifies the sound signals, and this amplification may vary with frequency in order to provide a good, hearable signal to a hearing device user. For example, amplification may be: greater for frequencies that are hard for the user to hear, less for frequencies that the user has a good audio response to and/or the like. In another example, sound signals in frequency bands associated with the human voice may be amplified more than sound signals associated with ambient noise so that the user can hear and engage in conversation.

Because each hearing device user has a specific hearing profile, which may be frequency-dependent, and because each hearing device user may have a specific desired hearing device response, the controller/signal processor may be individually adjusted/programmed for the hearing device user. In general, the adjustment/programming of the hearing device is performed in a fitting procedure, where an audiologist or the like tunes the controller/signal processor to the user's hearing loss and/or the user's hearing preferences. Tuning may comprise setting frequency dependant gain and/or attenuation for the hearing device.

Typically, the hearing device also comprises a classifier, sound analyser and/or the like. The classifier analyses the sounds picked-up/received by the microphone(s) and based upon analysis of the characteristics of the picked-up sounds classifies a hearing situation. For example, analysis of the picked-up sounds may identify that the hearing device user is: in a quiet conversation with another person, talking to several people in a noisy location; watching television; and/or the like.

The hearing device may have access to programs, software and/or the like, which may be stored in a memory system on the hearing device/controller, on an auxillary device, in the Cloud and/or the like, that may be addressed by the controller/signal processor. Once the hearing situation has been classified, a programme/software be selected and may be used to process the picked-up sound signals according to the classified hearing situation. For example, if the hearing situation is classified as a conversation in a noisy location, the programme/software may provide for amplification of frequencies associated with conversation and attenuate ambient noise frequencies. The controller unit may automatically select a programme/software based on the classified hearing situation and perform the signal processing. Manual setting of the software/programmes may also be performed by the user and/or the user may manually tune a programme/software selected by the controller.

The controller may be adjusted in the fitting procedure by an audiologist or the like to customize the controller's settings for the hearing device user. The controller settings, commonly referred to as parameters, may be adjusted separately for each program. Parameters may be adjusted according to empirical values determined from an average hearing device user's response, hearing loss measurements, tests performed with the hearing device user in different hearing situations and/or the like.

Fitting results are limited by the fact that the fitter cannot test the hearing device for the user in all the different hearing situations the listener may encounter and also because hearing situations cannot be accurately reproduced. Additionally, the hearing device user may not respond in the same manner in the fitting as he or she would in the real-life listening situation. As a result, the initial fitting of the hearing device may comprise a first fitting to meet the user's broad listening requirements and further fittings may be used to tune the hearing device using feedback from the user. However, these further fittings also have the same issues as the initial fitting in that the real-life hearing situations cannot be replicated.

Several methods have been proposed to address the issue of fitting hearing devices to an end user so that the hearing device provides a desired sound output to the end user in a listening situation.

For example, U.S. Pat. No. 7,889,879 (the "'879 patent") describes a programmable auditory prosthesis with trainable automatic adaption to acoustic conditions. In the '879 patent, an auditory prosthesis user may adjust a sound processing parameter of a first operation mode according to the user's preference and a processor in the auditory prosthesis may adjust a sound processing parameter of a second mode of operation based upon a user's previously selected settings.

In another example, United States Patent Publication No. 22016/0249144 (the "'144 patent application") describes a method for ascertaining wearer-specific use data for a hearing aid, a method for adapting hearing aid settings of a hearing aid, and a hearing aid system and setting unit for a hearing aid system. The '144 patent application describes identifying a problem that the hearing device user is having with a hearing device and recording the type of problem and operating data of the hearing device when the problem was encountered, i.e., the problem is identified and the response of the user is learned. This stored data is used later, to adjust operation of the hearing device to mitigate the hearing device problem.

SUMMARY

Embodiments of the present disclosure provide methods and system for intelligent hearing device performance management. In embodiments of the present disclosure, a psychoacoustic model is created based upon preferences of the hearing device user regarding operation of the hearing device. The intelligent hearing device performance management system of the present disclosure is configured to generate a psychoacoustic model for the user based upon the user's perception of the hearing devices performance, which perception may be different for the same hearing environment.

In some embodiments of the present invention, user preferences may be directly entered into the psychoacoustic model by the hearing device user. In some embodiments, user preferences may be generated in the psychoacoustic model by requesting feedback from the user with respect to the user's perception of hearing device operation, which feedback may include positive or negative user perception. In some embodiments, user preferences may be learned by the psychoacoustic model from the feedback.

In some embodiments, hearing occurrence and/or hearing activity data may be collected, which data may identify an activity the hearing device user is engaging in while using the hearing device; the hearing device activity may include the circumstances under which the hearing device is being used, such as the location, the weather, the temperature and/or the like. This hearing occurrence and/or hearing activity data may be added to the psychoacoustic model and may be used by the psychoacoustic model along with the user feedback to determine user preferences and/or perception of hearing device output with respect to the hearing occurrence and/or the hearing activity.

In some embodiments, the psychoacoustic model is used to adjust/control operation of the hearing device. In embodiments of the present invention, the hearing device intelligently learns the hearing device user's perception/preferences for different hearing environments, hearing occurrences and/or different hearing activities.

Learning/adaptive systems for hearing devices that record user settings for hearing environments and/or identify the occurrence of user problems with the settings of the hearing device, such as described for example in the '879 patent and the '144 patent application, cannot generate a psychoacoustic model for the hearing device as they do not include user perception input. Without user perception input, the learning methods of the '879 and the '144 patent applications, exclude some of the most important data necessary for intelligent learning for a hearing device, e.g., user satisfaction and/or degree of satisfaction. Without the input of user perception, the systems are also unable to determine the effect of user circumstances, hearing occurrence and/or hearing activity upon the user's perception of/preferences for hearing device operation.

Moreover, the previous learning/adaptive systems are acoustic problem solving systems, where changes to the hearing device's operating parameters by a user highlight that a problem exists and the hearing device records the changes so that when the same hearing environment is encountered the operating parameters are set by the hearing device for the user. However, such learning/adapting of hearing device parameters for an acoustic hearing environment are unable to determine if the applied solution provides user satisfaction and/or the effect of other, non-acoustic circumstances, such as hearing occurrence (when/where the hearing device is being used and/or with whom the hearing device user is engaging), hearing activity (what the hearing device user is doing) and/or the like. Hearing occurrence and hearing activity data describe what are the circumstances and what is happening when the user is using the hearing device, and this data can affect the user's perception of the hearing device's performance. Hearing activity covers all activities, which are strongly related to hearing; this includes, e.g. 'listening to someone or something', 'unattended hearing', but also reading a book, which describes a kind of 'inward hearing' or 'hearing to my own thoughts,' i.e. it's a bit less than "doing" and a bit more than "hearing. In embodiments of the present disclosure, this data is included in psychoacoustic model so that the user's perception/preferences can be analysed and the hearing device can intelligently learn how to customize its output to meet the user's preferences and hearing intentions.

By limiting data collection/recording to hearing situations where the user encounters a hearing problem with the hearing device, learning/adaptive systems, such as the '879 patent and the '144 patent application, cannot generate positive user perceptions, for example, when the user has a positive hearing experience in a hearing environment. Without such data, the learning/adaptive cannot truly learn and/or adapt to the user and/or cannot learn/adapt to the user in real-time. Moreover, by only collecting data associated with problems and/or not collecting any perception data associated with the problem and/or the solution, learning/adaptive systems do not collect all data necessary for intelligent learning and tend to create fluctuating models that produce varying predictions since the user may change the hearing device in a different manner when encountering the same hearing environment, depending on factors other than the hearing environment. For example, adjustments to the hearing device may be made by the user for reasons other than a problem with the hearing environment, for example a hearing device user may adjust amplification in a hearing environment when the user is tired or the like.

Furthermore, when a problem is detected with hearing device operation by the user, and the user adjusts the hearing device, but does not make any further changes to the hearing device/hearing device parameters, this may not mean that the user is satisfied with the hearing device operation.

In some embodiments of the present disclosure, the intelligent hearing device learning system of the present disclosure, the hearing device may provide a prompt to the user to input the user's perception of hearing device operation at that time. In some embodiments, the prompt may be an audible prompt, a visual prompt and/or a tactile prompt such as a vibration or the like. In response to the prompt, the user may provide perception data to the intelligent hearing device learning system of the present disclosure. For example, the user may use a user input on the hearing device, such as a button or the like, to input satisfaction, degree of satisfaction, dissatisfaction, degree of dissatisfaction and/or the like into the intelligent hearing device learning system. The use of the prompt in embodiments of the present disclosure, means that the intelligent hearing device learning system can collect data at times other than when the user makes a change to the hearing device parameters, such as when the user is satisfied with the hearing device operation.

In some embodiments, the intelligent hearing device learning system may record hearing device settings at the time of the user input in response to the prompt and/or before and after the prompt. The user input in response to the prompt, the hearing environment of the user at the time of the prompt and/or the hearing device settings at the time of the prompt (and/or before and after the prompt) may be input into the psychoacoustic model. In some embodiments of the present disclosure, further data/occurrence data at the time or the prompt may also be input into the psychoacoustic mode, for example occurrence data may comprise time, date, location, heart rate, breathing rate, activity engaged in by the user (listening to music, driving, walking, cycling, running, eating, talking to acquaintances, shouting, laughing, riding the train, talking on the phone, watching a film at the cinema, watching the television, sleeping and/or the like) and/or the like.

Hearing occurrence data provides information regarding the operating circumstances of the hearing device and/or a hearing activity of the user. For example, the occurrence data may provide that a user is using his or her hearing device in a library, which may be determined from sensed GPS data, at 7 o'clock at night, which may be determined from a date-time sensor. The user's perception of hearing device operation and/or preferences for hearing device operation under these circumstances may well be different to the user's perception/preferences when using the hearing device in the early morning in his/her home; even though the hearing environment is the same.

Occurrence data may be provided by one or more sensors that may either be attached to or in communication with the hearing device. Sensors may include: a GPS sensor, an accelerometer, a light sensor, a vibration sensor, an acoustic sensor, a humidity sensor, a pressure sensor, a date-time sensor, a face-recognition sensor and/or the like.

Prompts may be sent to the user when a hearing environment changes, when the user encounters a hearing environment and the controller adjusts one or more parameters in response to the encountered hearing response, after the user adjusts the hearing device manually and/or the like. In some embodiments, the user may input satisfaction into the intelligent hearing device learning system of his or her own accord, without prompting.

In some embodiments, the prompting and/or the user input to the intelligent hearing device learning system may be made directly via the hearing device. In other embodiments, the prompting and/or the user input may be made via a separate device. Merely by way of example, the separate device may be a device with a wired/wireless connection with the hearing device. For example, a smart phone, processor, tablet or the like may communicate with the hearing device to exchange data and may deliver a prompt to the user and/or receive the user input. The separate device may itself be in wired/wireless communication with other processing, software, memory and/or the like and this communication may involve communication with the cloud.

Sensors to determine further data, such as described herein, for the psychoacoustic model, may be integrated in the hearing device, be part of the separate device, may be separate sensors configured to communicate with the hearing device/separate device and/or may be in communication with the other processing, software, memory and/or the like. For example, location of the user may be determined using a global positioning system (GPS). The GPS may also be used to determine a user's activity, such as by identifying the user's location, tracking the user to determine how they are traveling or the like.

In some embodiments, adjustments to the hearing device by the user may be recorded and/or the hearing environment at the time of the adjustments and the adjustments and/or the hearing environment data may be added to the psychoacoustic model.

BRIEF DESCRIPTION OF THE DRAWINGS

In the figures, similar components and/or features may have the same reference label. Further, various components of the same type may be distinguished by following the reference label by a dash and a second label that distinguishes among the similar components. If only the first reference label is used in the specification, the description is applicable to any one of the similar components having the same first reference label irrespective of the second reference label.

Figure 1:
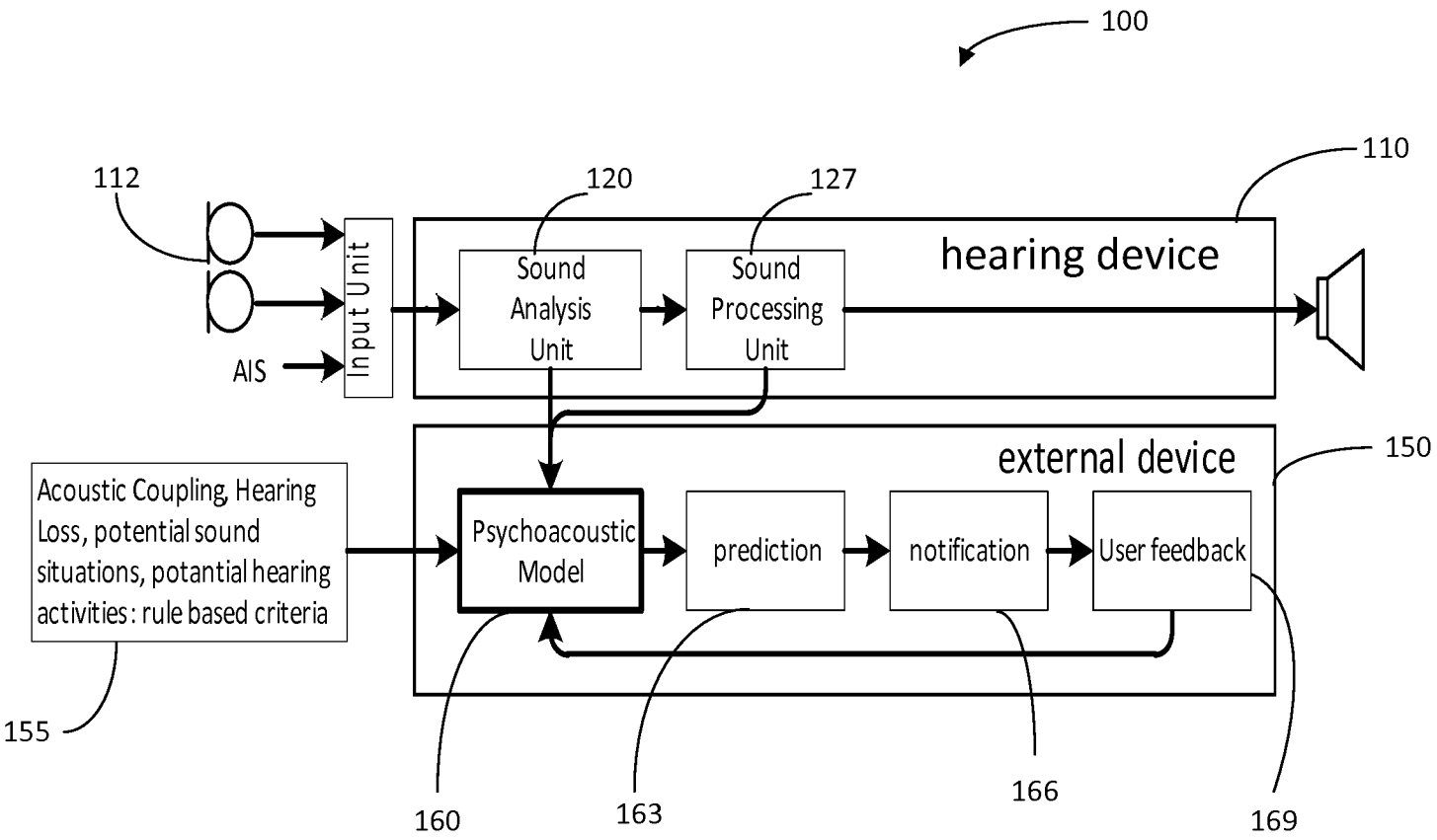
FIG. 1 illustrates a hearing system comprising a hearing device and an external device including an intelligent learning system that uses user perception of hearing device operation to learn the user's preferences in real-time, in accordance with some embodiments of the present disclosure.

These and further objects, features and advantages of the present invention will become apparent from the following description when taken in connection with the accompanying drawings which, for purposes of illustration only. Show several embodiments in accordance with the present invention.

DESCRIPTION

The ensuing description provides some embodiment(s) of the invention, and is not intended to limit the scope, applicability or configuration of the invention or inventions. Various changes may be made in the function and arrangement of elements without departing from the scope of the invention as set forth herein. Some embodiments may be practiced without all the specific details. For example, circuits may be shown in block diagrams in order not to obscure the embodiments in unnecessary detail. In other instances, well-known circuits, processes, algorithms, structures and techniques may be shown without unnecessary detail in order to avoid obscuring the embodiments.

Some embodiments may be described as a process which is depicted as a flowchart, a flow diagram, a data flow diagram, a structure diagram, or a block diagram. Although a flowchart may describe the operations as a sequential process, many of the operations can be performed in parallel or concurrently. In addition, the order of the operations may be re-arranged. A process is terminated when its operations are completed, but could have additional steps not included in the figure and may start or end at any step or block. A process may correspond to a method, a function, a procedure, a subroutine, a subprogram, etc. When a process corresponds to a function, its termination corresponds to a return of the function to the calling function or the main function.

Moreover, as disclosed herein, the term "storage medium" may represent one or more devices for storing data, including read only memory (ROM), random access memory (RAM), magnetic RAM, core memory, magnetic disk storage mediums, optical storage mediums, flash memory devices and/or other machine readable mediums for storing information. The term "computer-readable medium" includes, but is not limited to portable or fixed storage devices, optical storage devices, wireless channels and various other mediums capable of storing, containing or carrying instruction(s) and/or data.

Furthermore, embodiments may be implemented by hardware, software, firmware, middleware, microcode, hardware description languages or any combination thereof. When implemented in software, firmware, middleware or microcode, the program code or code segments to perform the necessary tasks may be stored in a machine-readable medium such as storage medium. A processor(s) may perform the necessary tasks. A code segment may represent a procedure, a function, a subprogram, a program, a routine, a subroutine, a module, a software package, a class or any combination of instructions, data structures or program statements. A code segment may be coupled to another code segment or a hardware circuit by passing and/or receiving information, data, arguments, parameters or memory contents. Information, arguments, parameters, data, etc. may be passed, forwarded or transmitted via any suitable means including memory sharing, message passing, token passing, network transmission, etc.

The phrases "in some implementations," "according to some implementations," "in the implementations shown," "in other implementations," and generally mean the particular feature, structure, or characteristic following the phrase is included in at least one implementation of the disclosed technology, and may be included in more than one implementation. In addition, such phrases do not necessarily refer to the same embodiments or different implementations.

Reference will now be made in detail to embodiments, examples of which are illustrated in the accompanying drawings and figures. In the following detailed description, numerous specific details are set forth in order to provide a thorough understanding of the subject matter herein. However, it will be apparent to one of ordinary skill in the art that the subject matter may be practiced without these specific details. In other instances, well known methods, procedures, components, and systems have not been described in detail so as not to unnecessarily obscure features of the embodiments. In the following description, it should be understood that features of one embodiment may be used in combination with features from another embodiment where the features of the different embodiment are not incompatible.

New self-fitting approaches (i.e. fitting and fine tuning in real-life) require detection of certain hearing situations, i.e. hearing situations, which assumedly provide either hearing advantages or hearing problems: While one can assume, that hearing problems may be detected by the user, it is not very probable, that hearing advantages become consciously detected by the user.

Detection of hearing problems (unsuccessful or negative hearing events) is required in order to verify, if a certain hearing situation is not only singularly identified as hearing problem, but repeatedly leads to hearing problems. Only if a certain hearing situation is continuously identified as creating a hearing problem, a permanent modification of hearing device settings, which are active in this situation, is recommended; otherwise a modification should only be applied temporarily.

Detection of hearing advantages (successful or positive hearing events) is required in order either to ensure, that a modification has been successfully applied or to demonstrate benefit of the hearing device and therefore to put the focus also on positive hearing events and not only on negative events and hence to elevate acceptance of the hearing devices.

Besides detection of certain hearing events new self-fitting approaches require actions to be performed by the hearing device or the user, based on the kind of detected hearing situation, e.g. answering questions about the current situation or trying out optimized hearing device settings for this specific hearing situation. Such actions have to be triggered by the hearing system, which has additionally to consider certain conditions, e.g. how much time has been passed by since last action, has an action to be requested later again, if the user is currently not able to perform the required action, does the user need any kind of reminder, . . . .

FIG. 1 illustrates a hearing system comprising a hearing device and an external device, the hearing system including a perception-based intelligent learning system, in accordance with some embodiments of the present disclosure.

In FIG. 1, a hearing system 100 comprises a hearing device 110 in communication, either wired or wireless communication, with an external device 150. The hearing device 110 is configured to receive/detect an acoustic input, via an input unit 112, which may comprise one or more microphones, receivers, antennas or the like. The acoustic input may include acoustic data that is produced by the hearing environment. For example, the hearing environment may comprise engine noise generated by a car, crowd noise generated by a number of people in proximity to one-another and/or the like.

The hearing device 110 includes a sound analysis unit 120 that may identify/classify the hearing environment from the acoustic input and a sound processing unit 127 that may process the received acoustic input in view of the identified/classified hearing environment.

In embodiments of the present disclosure, the external device 150 comprises a psychoacoustic model 160 that is pre-configured with hearing device operation data 155. This hearing device operation data 155 may comprise: data about a hearing device user, such as hearing loss data; data about operation of the hearing device 110 for the user, such as e.g. acoustic coupling data (is the hearing device vented/open or sealed to the user's ear canal) and the user preferences for hearing device operation, normally determined during fitting; potential sound situations, which may also be referred to as listening environments, which may include situation such as driving in a car, eating in a restaurant, watching television in a large room, listening to music at a concert, talking in a crowd, listening to a speaker in a hall and/or the like; potential hearing activities, such as engaging in a conversation, listening to music, watching television, attending a concert, eating, exercising, reading, using the phone and/or the like; and rule based criteria, which are models that are applied to the acoustic input by the sound processing unit 127 to produce an acoustic output of the hearing device 110, which are based upon producing an optimized/improved acoustic output for the acoustic coupling, hearing loss, sound situation and/or potential hearing activities.

In some embodiments, the hearing device operation data 155 is pre-configured in the psychoacoustic model 160 in the external device 150. In use, the psychoacoustic model 160 receives sound analysis from the sound analysis unit 120 and processes this sound analysis using the hearing device operation data 155 to make a prediction 163 with respect to the occurrence of a hearing event, where the hearing event comprises: a hearing problem where, from the sound analysis and the hearing device operation data 155, the psychoacoustic model 160 determines that a hearing problem has/will occur, such as poor audibility, intelligibility, hearing comfort, sound quality and/or high listening effort; or a hearing advantage has/will occur, such as good audibility, intelligibility, hearing comfort, sound quality and/or low listening effort. The psychoacoustic model 160 may also predict that a hearing-neutral-event has/will occur, where a hearing-neutral-event is a situation neither providing a hearing problem nor a hearing advantage.

If the occurrence of a hearing event is predicted by the psychoacoustic model 160, the hearing system 100 may adjust the hearing device operating parameters of the hearing device 110 to address the hearing problem or may record/communicate that the hearing device 110 is operating in a manner providing a hearing advantage. After adjusting the hearing device operating parameters or recording the existence of a hearing advantage, the hearing system 100 provides a notification 166 to the hearing device user. The notification 166 may be made by an acoustic, visual, haptic and/or the like notification. In response to the notification 166, a user feedback 160 is provided by the user to the psychoacoustic model 160. The psychoacoustic model 160 processes the user feedback 166 along with the sound analysis and/or the operating parameters of the hearing device 160 at the time of the notification to customize the model to the user's perception/preferences.

As described, embodiments of the present disclosures, provide for intelligent performance management of the hearing device 110 by using the psychoacoustic model 160 to identify/predict hearing events and to receive user feedback with respect to functioning of the hearing device 110 and/or proposed functioning of the hearing device 110 during the hearing events. The psychoacoustic model 160 may propose/implement solutions to hearing problems, receive validation from the hearing device user of solved hearing problems, and/or identify hearing advantages to the user and receive user feedback as to the identified hearing advantages.

In some embodiments, during fitting of the hearing device 110, the hearing device user may be questioned about hearing situations/hearing environments the user encounters. The more specific a hearing situation can be identified as problematic or advantageous, the more specific the user can be asked about such hearing situations; which means, the more specific the hearing system can request the user to describe certain hearing situations and the less invasive such a hearing system will work. In this way, the psychoacoustic model 160 can be pre-configured with hearing situations and user preferences and the less often the hearing system has to request user feedback.

In addition to preconfiguring the psychoacoustic model 160 with certain sorts of hearing situations, hearing events, that create hearing problems or advantages, can be predetermined by considering hearing loss of the user, properties of the hearing device (i.e. signal processing and acoustic coupling) and properties of an acoustic situation. In embodiments of the present disclosure, the user may show a different individual perception to these hearing events and the criteria for determining possible hearing problems or hearing advantages may be adjusted to the individual perception of the user.

In some embodiments, the psychoacoustic model 160 may start by using rule-based criteria, which were preconfigured in the psychoacoustic model 160, to determine the existence of or predict a hearing problem or hearing advantage. Merely by way of example, if the signal-to-noise ratio is low, rule based criteria will provide a hearing problem, namely, that speech intelligibility is also expected to be low. In another example, or hearing advantages when low signal-to-noise ratio is detected, rule based criteria provide that a hearing advantage can be produced by the hearing device 110 by amplifying frequencies to increase speech intelligibility.

In embodiments of the present disclosure, the hearing device system 100 may check the validity of these rules for the perception of the hearing device user by requesting and obtaining the user feedback 160. For example, the hearing device system 100 may provide the notification 160 to the user to obtain the user feedback 169 as to whether the user is experiencing poor speech intelligibility when low signal-to-noise ratio acoustic input is being received; where the user feedback 169 may comprise satisfaction/dissatisfaction feedback. Similarly, the hearing device system 100 may provide the notification 160 to the user to obtain the user feedback 169 as to whether the user is experiencing good speech intelligibility when low signal-to-noise ratio acoustic input is being received, but the sound processing unit 127 has been controlled to amplifying frequencies to increase speech intelligibility; where the user feedback 169 may comprise satisfaction/dissatisfaction feedback.

The user feedback 160 is then added to the psychoacoustic model 160 to provide an understanding of user perception; either confirming or providing a degree of confirmation that the rule based criteria is consistent with user perception or confirming or providing a degree of confirmation that the rule based criteria is inconsistent with user perception. In some embodiments of the present disclosure, non-acoustic data, such as user activity data (what the user is doing) and/or occurrence data (location, date, time) may be associated with the hearing event and the associated rule based criteria. In such embodiments, when the same hearing event is encountered by the user, in the event of having received positive user feedback, the psychoacoustic model 160 may adjust operating parameters of the hearing device in accordance with the rule based criteria and use the new user feedback and differences or similarities in the user activity and/or occurrence data to tune the psychoacoustic model 160. Similarly, when the same hearing event is encountered by the user, in the event of negative user feedback, the psychoacoustic model 160 may adjust the operating parameters of the hearing device 110 in a manner consistent with the negative feedback make and use the new user feedback to such adjustment and differences and/or similarities in the non-acoustic data to tune the psychoacoustic model 160. In embodiments of the present disclosure, user feedback to the same adjustments by the psychoacoustic model 160 to the operating parameters of the hearing device 110 may be used to identify the effect of non-acoustic data, such as user activity data and/or occurrence data of user perception and to tune the psychoacoustic model 160 to account for this user perception. Merely by way of example, in embodiments of the present disclosure, the psychoacoustic model 160 may determine that the user has an adverse perception with respect to amplifying speech frequencies in the late evening when a low signal-to-noise ratio is detected compared to the same amplification at other times of the day, and may use this information for controlling the operating parameters of the hearing device 110.

Rule based criteria may consider general hearing problems, such as hearing loss, properties of the acoustic coupling, properties of acoustic situations and the signal processing characteristic of the hearing device related to these acoustic situations. In some embodiments, the hearing system is pre-configured with hearing device understanding data 155, which includes rule based criteria that may comprise one or more operation ranges, e.g., ranges for hearing device operating parameters that produce an output that address a hearing problem and fit within the user's acoustic sound-scape, e.g., sounds that can be adequately heard by the user.

In some embodiments, as the hearing system 110 is used in real-life, the hearing system 110 validates the pre-configured rule-based criteria by requesting/receiving (preferably short) descriptions of the user's perception of the current hearing situation or simply by monitoring user inputs on a user control (i.e. no input=no hearing problem; input=hearing problem). However, "no input" does not necessarily mean, that there is no hearing problem, therefore, in some embodiments of the present disclosure, an active request, the notification 166, is provided to the user. The notification 166 may ask whether the user has a satisfactory perception of operation of the hearing device 110 and/or to at describe the current situation as "problematic" (hearing problem) or "easy" (hearing advantage).

Over the course of time, the hearing system 100 collects the user feedback 160 for a rule based criteria and an associated operating range and tunes the rule based criteria and/or the operating range to the user feedback. In some embodiments, the hearing system, through analysis of the user feedback 160 and the user activity/occurrence data learns how to apply the rule based criteria and the associated operating range for different user activities and/or occurrences.

In some embodiments, if the user feedback 160 is inconsistent with the pre-configured rule based criteria, the hearing system may adjust the rule based criteria to the user's feedback. The hearing system may use this customized user criteria when the same hearing event is encountered.

In some embodiments, the hearing system 100 proceeds with validating user criteria and may repeatedly adjust and validate the rule based criteria. This procedure may be continued permanently, or until a more or less stable user feedback is obtained, i.e., the user feedback is generally positive. The repeated adjustment and validation may also only be performed when further situations showing hearing problems and hearing advantages are encountered, or only for a limited period-of-time or on request of the fitter or the user.

Over the course of time, the hearing system is able to better analyse the structure of hearing problems and hearing advantages and this results in a decrease in the necessary number of requests and reduces unneeded invasiveness of the system.

In some embodiments, the notification 166 comprise an indication for the occurrence of the hearing problem or the hearing advantage. The notification 166 may be an acoustic notification, e.g. a sound message directly outputted by the loudspeaker of the hearing device or of the external device, a haptic or vibration alarm, a visual alarm, e.g. a flashing light, outputted by the external device In some embodiments, the user responds to the notification 166 by providing the user feedback 160. The user feedback 166 may be provided via a user input using, such as user control elements on the hearing device 110 and/or the external device 150, e.g. toggle elements, switches, rockers and/or the like. Positive or negative feedback can be coded by up/down movement of a rocker input, operating a switch to the left or right and/or the like. User control elements on the external device 150 may comprise, keys, a touchscreen, a graphical user interface, buttons and/or the like with or without acoustic or haptic feedback.

In some embodiments, depending on hearing loss, acoustic coupling of the hearing system (i.e., whether the hearing device coupling is open, vented or sealed with the user's ear canal), signal processing of the hearing system and/or hearing situations, certain rules for identifying possible hearing problems or hearing advantages may be preconfigured in the psychoacoustic model 160. For example, for moderate hearing loss, open coupling of the hearing device, speech in loud noise, weak strength of beamformer probability for a hearing problem is high. By way of another example, for moderate hearing loss, closed coupling, speech in medium loud noise, strong strength of beamforming, the probability for a hearing advantage is high. And in a further example, for mild hearing loss, open coupling, speech in quiet environment, weak strength of sound cleaning (beamformer, noise canceller), the probability for a hearing problem is low.

In some embodiments, for a user with moderate hearing loss, closed coupling, music, weak strength of sound cleaning (beamformer, noise canceller), the probability for using a rule based criteria to provide a hearing advantage is high. Criteria for hearing problems in such situations are poor audibility, poor intelligibility, poor hearing comfort, poor sound quality and/or high listening effort. Hearing advantages that may be provided using the rule based criteria are good audibility, good intelligibility, good hearing comfort, good sound quality and/or low listening effort.

In some embodiments, the psychoacoustic model 160 predicts the occurrence of potential hearing events, hearing problems and hearing advantages, based on the individual hearing loss of the user, acoustic coupling conditions, the performance and/or configuration of the hearing device 110, the hearing environment and/or the like. Based on these considerations, the psychoacoustic model 160 makes the prediction 163.

Hearing events (e.g. hearing problems/advantages), are detected from data about the hearing environment, determined by the sound analysis unit 120 and/or the signal processing provided by the sound processing unit 127.

Analysis of this data with regard to hearing loss of the user, acoustic coupling and/or the like may detect a hearing event. In embodiments of the present disclosure, the psychoacoustic model 160 processes the data to detect the hearing event.

In some embodiments, if the hearing system 150 detects a possible hearing problem or hearing advantage, the user is provided with the notification 166, which may comprise notifying the user and requesting further actions, e.g. confirming or declining the prediction, describing the current hearing perception of the user, trying out proposed alternative modifications and/or comparing alternative hearing device settings. If the user does not respond to the notification, the system may repeat notifications for a certain time or a certain number or repetitions as long as the current hearing event is still occurring. If the user does not respond until the end of a given time or the maximum number of notifications is achieved, the system stops notifying for the current hearing event. If the user does not want to be disturbed for a certain time, he puts the system into sleep-mode for a configurable time. During sleep-mode no further notification dropped by the system will occur.

In some embodiments, the psychoacoustic model for the user may be modified based on user feedback to a notified hearing event. If the user confirms a predicted hearing event, the rule for detecting this hearing event becomes also confirmed. If the user declines a predicted hearing event, the system adjusts the respective rule for detecting this hearing event, e.g. the threshold for predicting such a hearing event is adjusted or this specific combination of signal processing and acoustic situation for given hearing loss and acoustic coupling condition is taken out from the applied set of rules for detecting hearing events. Optionally the system may first collect a certain amount of denials (e.g. at least 3) until the set of rules becomes adjusted. In the course of time, the hearing system adapts the prediction of hearing events to the individual user.

In some embodiments, the customized psychoacoustic model is used for further fine tuning of the hearing device 110. In some embodiments, if the prediction 163 of the psychoacoustic model 160 is validated by a sufficient number of user responses—i.e. if the variability of user responses has reached a plateau and will no longer diminish, or if a predefined time has passed, or a certain number of responses is collected—the customized psychoacoustic model 160 can be used for further fine tuning for this user.

In some embodiments, the hearing system 100 may comprise the hearing device 110 and the external device 150. In such embodiments, the psychoacoustic modelling procedures may be performed as depicted, on the external device 150. The external device 150 may comprise a smartphone, smartwatch, remote control, processor, tablet and/or the like that is capable of communicating with the hearing device. In some embodiments, some or all of the psychoacoustic modelling procedures may be performed on the hearing device 110 and the external device 150 may not be needed.

In some embodiments, the external device 150 may be connected via the Internet to an external server (not shown). This external server may be a cloud based server and may perform all or part of the psychoacoustic modelling procedures and/or store data regarding the hearing environment, the user feedback, the rule based criteria, the user criteria, the hearing activity, the occurrence data and/or the like. The server may feed-back processed results to the hearing device 110 and/or the external device 150. In some embodiments, the hearing system 100 is directly or via a relay linked to the server.

Figure 2:
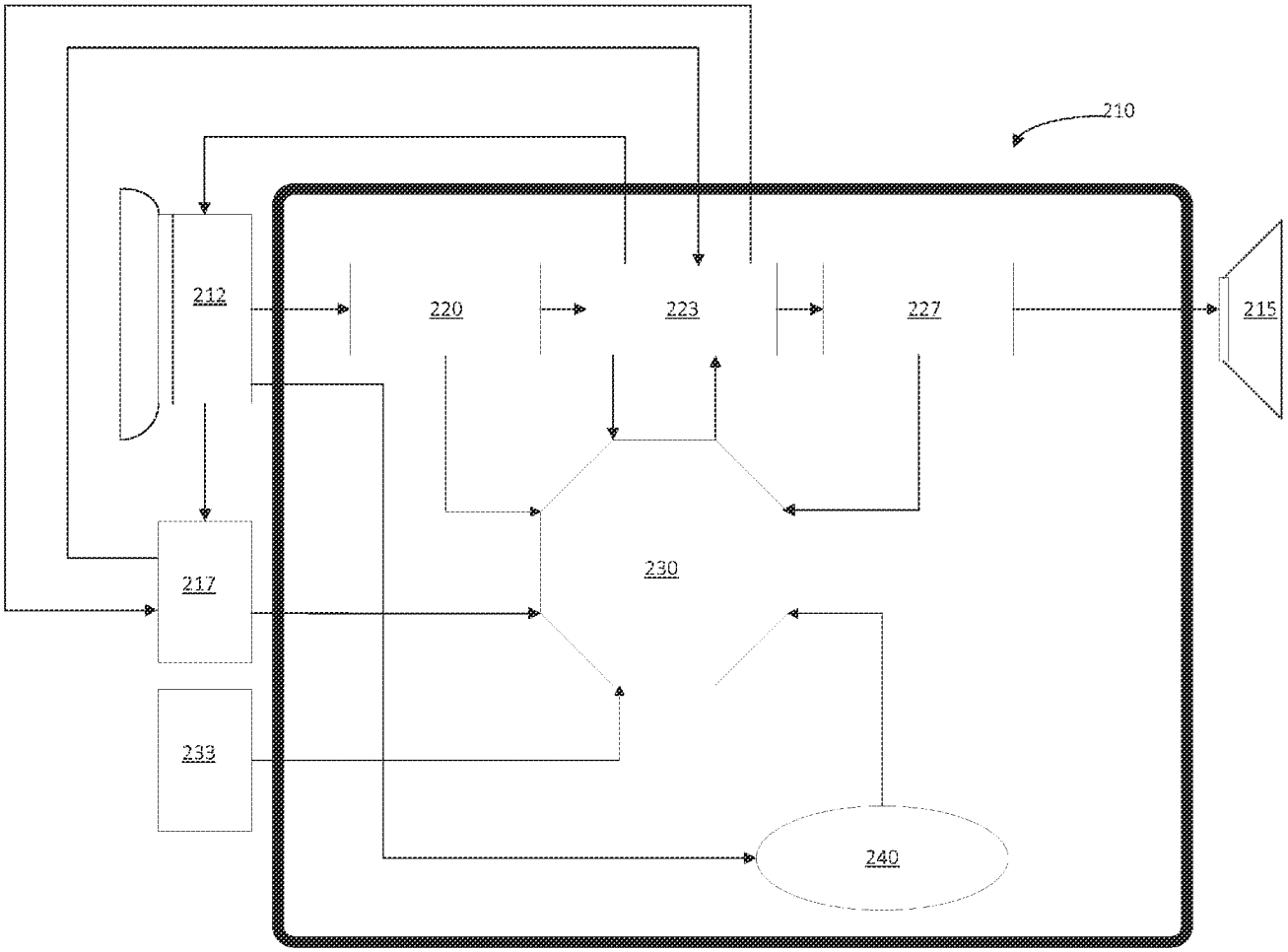
FIG. 2 illustrates a hearing device comprising an intelligent, online perception-based management system, in accordance with some embodiments of the present disclosure.

FIG. 2 illustrates a hearing device comprising an intelligent perception-based management system, in accordance with some embodiments of the present disclosure.

As illustrated in FIG. 2, a hearing device 210 comprises an acoustic input 212 and an acoustic output 215. The acoustic input 212 may comprise one or more microphones configured to receive/pick-up acoustic signals. For example, the acoustic input 212 may comprise a microphone located in or proximal to a hearing device user's ear configured to pick-up/receive sounds at or around the ear. The acoustic input 212 may include a microphone disposed in the hearing device user's ear canal, which may for example pick-up the user's own voice. Multiple microphones, including microphones external to the hearing device, may be coupled with the hearing device to provide an acoustic input to the hearing device. The acoustic input 212 may include a receiver that can receive wi-fi signals, streams, Bluetooth signals and/or the like. For example, the receiver may comprise an antenna or the like and may receive acoustic signals and/other data from a smartphone, a smart watch, an activity tracker, a processor, a tablet, a smart speaker and/or the like for input into the hearing device 210.

Acoustic signals from the acoustic input 212 are passed to a classifier 220, which may comprise or be a part of a sound analyser or the like. The classifier 220 comprises processing circuitry configured to process the acoustic input signals to classify a hearing environment. For example, the classifier 220 can process the input acoustic signals to determine that the hearing device/hearing device user is: in a car, in a noisy environment, engaged in a conversation, in a room, outside; and/or the like.

The classifier 220 communicates its classification of the hearing environment to a controller 223. The controller 223 may comprise processing circuitry, software and/or the like. The controller 223 processes the classified hearing environment and controls a signal processor 227 to process the acoustic input and provide the processed acoustic input to a receiver 215, which may comprise a transducer, speaker and/or the like that generates an acoustic output. Merely by way of example, the controller 223 may be programmed to select amplifications of different frequencies of the acoustic input depending upon the classified hearing environment. In general, the hearing device 210 will initially be programmed with standard signal processing settings for each of a set of a set of classified hearing environments and the controller 223 will control the signal processor 227 to apply these standard signal processing settings to the acoustic input. By way of example, if the hearing environment is classified by the classifier 220 as comprising a conversation in a noisy environment, the standard signal processing settings for such environment may provide for amplification of frequencies associated with speech and no amplification or may be even suppression of frequencies associated with ambient/background noise. In some embodiments, the controller 223 and the signal processor 227 may comprise be included in the same processing circuitry.

In general, the hearing device 210 is fitted by a hearing device professional to a user. This fitting comprises placing the user in simulated situations and tuning the standard signal settings on the controller 223 to the user's preferences. The problem with such fitting procedures is that not all real-life hearing environments can be simulated and/or the simulations may not be accurate. Previously, such as described in the '144, this problem has been addressed by including an analysis unit or the like on the hearing device. The analysis unit is used to determine when a hearing device user is having problems with the output from the hearing device. Commonly, these problems are determined by the user making manual changes to the hearing device settings. The analysis unit may be used to identify when the user encounters a hearing problem with the hearing device, ascertain what the hearing environment was when the problem occurred and what settings the user set to address the hearing problem. This data may then be used to tune the hearing device settings and customize the hearing device to the user.

In some embodiments of the present disclosure, a psychoacoustic modeller 230 may receive the classification of the hearing environment determined by the classifier 220, controller settings of the controller 223 and/or a controller output from the controller 223. In this way, the psychoacoustic modeller 230 is provider with data regarding the hearing environment, a status of the controller 223 and/or an output of the hearing device 210.

In some embodiments of the present disclosure, a hearing device user may use a parameter input 217 to adjust the hearing device's parameter settings. In this way, the user may adjust the parameters for the controller 223 to adjust the sound processing produced by the signal processor 227, and thus, the acoustic output of the hearing device 210. By way of example, if the controller 223, based on a hearing environment classification, controls the signal processor 227 to provide an acoustic output via the receiver 215 that the user finds too quiet, the user may adjust hearing device parameters using parameter input 217 to amplify the acoustic output. In some embodiments, the changes to the acoustic parameters made by the user are input to the psychoacoustic modeller 230.

The psychoacoustic modeller 230 may comprise processing circuitry, software memory, a database and/or the like that can receive input data and generate a psychoacoustic model from the input data. The psychoacoustic modeller 230 is configured to generate a psychoacoustic model of the hearing device user's perception of the output from the hearing device 210 and to control the hearing device 210 to provide an output that is consistent with the user's preferences. In some embodiments, the psychoacoustic modeller 230 generates a range(s) of acoustic outputs that are acceptable to the user and controls the hearing device 210 to produce an acoustic output within this range, given other constraints that may exist, such as hearing device performance limits, the hearing environment, the location and/or the like.

In some embodiments of the present disclosure, the hearing device 210 includes a user perception input 233. The user perception input 233 may in some aspects provide for the hearing device user directly inputting a perception of the acoustic output to the psychoacoustic modeller 230. For example, in some embodiments, after the user has adjusted a hearing device operating parameter and/or after the psychoacoustic modeller 230 and the controller 223 have interfaced to adjust a hearing device operating parameter, the user may input satisfaction data to the psychoacoustic modeller 230 via the user perception input 233. In some embodiments, the user perception input 233 may comprise one or more buttons on the hearing device 210 and the user may use the one or more buttons to express satisfaction with hearing device operation after the parameter adjustment. For example, the user may push one of the buttons to show satisfaction and/or may push one of the buttons to show dissatisfaction. In some embodiments, a degree of satisfaction/dissatisfaction may be expressed by the duration for which the button is engaged by the user.

As discussed with respect to FIG. 1, a notification may be provided to the hearing device user requesting input of user perception data. Such a notification may be sent when a hearing event has occurred or been predicted, such as when the psychoacoustic modeller 230 determines that a change to the acoustic output should be made or after such a change has been made. In embodiments of the present disclosure, the user perception provides for generation of a psychoacoustic model for the hearing device user whilst the hearing device 210 is being used in everyday life.

For example, the psychoacoustic modeller 230 may control, the hearing device 210 to produce an acoustic output in a classified hearing environment in accordance with a previous time that the same or a similar hearing environment was encountered by the user. By obtaining user perception data after adjusting the hearing device 210, the psychoacoustic modeller 230 can build/tune a psychoacoustic model that is consistent with the user's perception. In another example, if the psychoacoustic modeller 230 receives a negative or weakly positive user perception input, the psychoacoustic modeller 230 may adjust the acoustic output of the hearing device 210 until it receives a more affirmative user perception, and may generate/tune the psychoacoustic model according to the hearing device settings/acoustic output corresponding to the more affirmative user perception. In both these examples, generation/tuning of the psychoacoustic model may be performed at least in part based upon positive user perception data.

In some embodiments, the user perception input 233 may be on a separate device from the hearing device 210, such as a smartphone, processor and/or the like, and a graphical user interface may be interacted with by the user to show satisfaction dissatisfaction with the adjusted hearing device operating parameters. In some embodiments, a prompt may be provided to the user to input data via the user perception input 233. For example, a tone may be provided by the hearing device and/or an external device may provide a sound prompt, a visual and/or the like.

In some embodiments of the present disclosure, the hearing device user may input hearing activity data to the psychoacoustic modeller 230. For example, when the hearing device user changes an operating parameter of the hearing device 210, the user may input a hearing activity into the user perception input 233. In some embodiments, the psychoacoustic modeller 230 may interface with the hearing activity sensor 240 and provide a list of potential hearing activities to the user and the user may select one or more of these activities as an input to the user perception input 233. In such embodiments, the psychoacoustic modeller 230 may produce a psychoacoustic model for the user by associating a preferred user hearing device operating parameter(s) with a hearing activity.

Previously, learning/adaptive systems have essentially been acoustic problem solvers, where the system learns what settings a user has previously input for a hearing environment and applies them the next time the user encounters the same hearing environment. Such a system is limited in its ability to learn as it is only gathers user data when a problem occurs, the user changes settings. In embodiments of the present disclosure, user data concerning user satisfaction/preference is also gathered. For example, after adjusting a hearing devices operating parameters, in some embodiments, the user may be prompted for user satisfaction input even though the user has not made any hearing device parameter changes. Satisfaction data can thereby be used by the psychoacoustic modeller 230 to generate the psychoacoustic model. Further, while a user may not make changes to the hearing device parameters after changes have been made by the controller 223, the user may not be completely satisfied with the resulting hearing device operation, but may not want or be able to tune the parameters further. Such information, which is not collected by existing learning/adaptive hearing device systems, can be used by the psychoacoustic modeller 230 to generate a psychoacoustic model that is better tailored to the user.

In some embodiments of the present disclosure, the psychoacoustic modeller 230 receives the classification of the hearing environment determined by the classifier 220, controller settings of the controller 223 and/or a controller output from the controller 223. In some embodiments of the present disclosure, in addition to the data input to the psychoacoustic modeller 230 described above, at least one of: user occurrence data, user activity data and user preference data is provided to the psychoacoustic modeller 230. Occurrence data describes the circumstances when the hearing device 210 is being used, such as the time, place, location, physical situation, who is present and/or the like. User activity data describes activity of the user while using the hearing device, such as walking, driving, reading, running, conversing, eating, listening to music, watching television, and/or the like.

Occurrence and user activity data is collectively referred to herein as hearing activity data. In some embodiments, the hearing activity data may be provided to the psychoacoustic modeller 230 when the user adjusts parameters on the hearing device 210, when a hearing event is detected and/or when a user provides perception feedback.

Hearing activity data may be sensed by the hearing activity sensor 240, which may comprise for example: a time sensor, a date sensor, a light sensor, a motion sensor, an accelerometer, an activity sensor, a speed sensor, a GPS sensor, a heart rate sensor, a face-recognition sensor, a voice recognition sensor, a speech analyser, a language detection sensor, a thermal sensor, a temperature sensor, a weather sensor, a humidity sensor, orientation sensor, an acoustic sensor, a reverberation sensor, a pressure sensor, a vibration sensor, connectivity sensor and/or the like. The hearing activity sensor 240 may comprise processing circuitry, software and/or the like configured to process the sensed data to provide hearing activity data to the psychoacoustic modeller 230.

For example, the hearing activity sensor 240, may process sensed GPS data, such as GPS tagging data, to determine a place/location of the hearing device/hearing device user, which may comprise a geographical location, the type of premises associated with the hearing device/hearing device user's location and/or the like. The hearing activity sensor 240 may process sensed GPS sensor to determine how the hearing device user is travelling, for example, by bike, by car, by train or the like. The hearing activity sensor 240 may process GPS data, heart rate data, motion data, accelerometer data, activity data and/or the like to determine a user activity, such as walking, exercising, sitting, laying down and/or the like. The occurrence sensor may process weather data, temperature data, pressure data and/or the like to determine atmospheric conditions for the hearing device/hearing device user. The hearing activity sensor 240 may process speech recognition data, facial recognition data, language detection data, speech analysis data and/or the like to determine types of people interacting with and/or who is proximal to/interacting with the hearing device/hearing device user. The hearing activity sensor 240 may process light sensor data, thermal/temperature data, reverberation data, vibration data, acoustic data and/or the like to process the conditions associated with a location of the hearing device/hearing device. The hearing activity sensor 240 may process connectivity data to determine how the hearing device is receiving data, the state of the received data (such as signal strength, noise-to-signal ratio and/or the like), what other devices the hearing device is connected to or with which it could be connected and/or connectivity parameters with respect to such devices, such as connection means (Wi-Fi, Bluetooth, etc.), operation characteristics of the connection means and/or the like.

In some embodiments, the hearing activity sensor 240 is apart of the hearing device 210. In some embodiments, the hearing activity sensor 240 is a separate device that is capable of communicating with the hearing device 210. For example, the hearing activity sensor 240 may be part of a tuning device that the hearing device user carries for a period-of-time after the hearing device 210 has been fitted. In such embodiments, the tuning device may collect data and the user may return to a fitting professional to have the psychoacoustic modeller 230 tuned to the user, based upon the collected data. In some embodiments, the hearing activity sensor 240 may comprise a smartphone, smart watch, activity tracker, processor, tablet, smart speaker or the like capable of communicating with the hearing device 210. The smartphone, processor, smart watch, activity tracker and/or the like may be carried by the hearing device user and may communicate occurrence data to the hearing device and/or receive data from the hearing device 210.

In some embodiments, data from the hearing activity sensor 240 is provided to the psychoacoustic modeller 230. In embodiments of the present disclosure, the psychoacoustic model 230 may associate occurrence data with a change in a hearing device parameter(s) made by the user. In this way, the psychoacoustic modeller 230 can generate a psychoacoustic model for the user. For example, when the hearing device user adjusts a hearing device parameter for a classified hearing environment, the psychoacoustic modeller 230 may associate the classified hearing environment, the changed hearing device parameter and the occurrence data to produce a predicted user preference. Then, when the hearing device user encounters the same hearing environment and occurrence, the psychoacoustic modeller 230 can interface with the controller 223 to control the signal processor 227 to provide an acoustic output consistent with the changed parameter determined previously by the hearing device user.

In embodiments of the present disclosure, the psychoacoustic modeller 230 may intelligently learn a user's perception preferences for not only different hearing environments but also for different hearing activities as well as for different combinations of hearing activities and hearing environments. By way of example, a user may encounter a secondary hearing environment that is given the same classification as a previous hearing environment encountered by the user. In response, the psychoacoustic modeller 230 may interface with the controller to provide an acoustic output similar to the output produced for the previous hearing environment. However, if the psychoacoustic modeller 230 receives a negative perception from the user to this adjustment for the secondary hearing environment, which may be in the form of direct perception input by the user or by the user changing the operating parameters of the hearing device 210, the psychoacoustic modeller 230 can process this difference in user perception. The psychoacoustic modeller 230 may, in some embodiments, provide a notification to the user to provide feedback regarding why the user perception of the adjustment for the secondary hearing environment is negative and may tune the psychoacoustic model accordingly. In other embodiments, the psychoacoustic modeller 230 may compare hearing activity data for the secondary hearing environment and the previous hearing environment and may use the differences to tune the psychoacoustic model.

In some embodiments, the psychoacoustic modeller 230 may use user perception data to associate hearing device parameters with a hearing activity. For example, a hearing device user may be in a hearing environment, such as a restaurant, and may be interacting with a smartphone or the like. The controller 223 may be configured in such a hearing environment to suppress noise and to amplify speech frequencies so that the user can interact with people at the restaurant. However, given the hearing activity of using a smartphone, the psychoacoustic modeller 230 may negate the actions of the controller 223 so that the user can still hear the surrounding sounds whilst using the smartphone or may suppress all frequencies to provide for a low acoustic output to the user.

In some embodiments, the controller 223, as well as being capable of controlling the signal processor 227, may also control other operating parameters of the hearing device 210. For example, the controller may be able to control the connectivity of the hearing device 210. For example, the controller 223 may control what communication protocols—Wi-Fi, Bluetooth or the like—are used for communicate with the hearing device 210 and/or have preference for such communication, and may for example, in flight mode or the like turn-off a communication protocol on the hearing device 210. Similarly, the controller 223 may control communication by the hearing device 210 with external devices—smartphone, smart speaker, computer, another hearing device, external microphones and/or the like—and/or may control a set of preferences for such external devices. The controller 223 may also control other operating features of the hearing device 210, such as for example, the venting provided by the hearing device 210, which affects the acoustical performance of the hearing device, the operation of the hearing device microphones receiving the sound data and/or the like.

In some embodiments of the present disclosure, status of any of the operating parameters of the hearing device 210 may be provided to the psychoacoustic modeller 230, and the psychoacoustic modeller 230 may interface with the controller 223 to control such operating parameters. For example, the hearing device user may operate the hearing device 210 to interact with an external device during an occurrence and the psychoacoustic modeller 230 may use this information to generate the psychoacoustic model, and may interface with the controller 230 to set the operating parameters of the hearing device 210 for communication with the external device selected by the hearing device user when the occurrence is next encountered.

In some embodiments of the present disclosure, the psychoacoustic modeller 230 may use positive, satisfactory feedback associated with an acoustic output in a hearing environment to build the psychoacoustic model for the user. If repeated positive feedback is received for the acoustic output in the hearing environment, the psychoacoustic model is weighted accordingly. If, however, negative feedback is received for the same or a similar acoustic output in the same or a similar hearing environment the psychoacoustic model is changed accordingly. Merely, by way of example, when such negative feedback is received, the psychoacoustic modeller 230 may look for differences between the hearing environments. If differences are detected, the psychoacoustic modeller 230 may update the psychoacoustic model to associate operating parameters of the hearing device that the user either manually adjusted and/or were provided by the psychoacoustic modeller 230 in response to the user's negative feedback. In some embodiments, confirmation of the resolution of the hearing problem encountered by the user is provided by receiving positive feedback to the adjusted acoustic output.

In some embodiments, the psychoacoustic modeller 230 may look for differences between user activity/occurrence data at the time of the negative feedback compared to when positive feedback was previously received for the same/similar acoustic output in the same/similar hearing environment. In this way, user activity/occurrence data can be added to the psychoacoustic model. Additionally, the psychoacoustic modeller 230 can verify its psychoacoustic model from positive feedback from the user when the psychoacoustic modeller 230 controls the hearing device 210 to produce the same or a similar acoustic output for the same or similar acoustic environment and the same or similar user activity/occurrence. In some embodiments, if the user does not change the operating parameters of the hearing device after such a change is made by the psychoacoustic modeller 230, this may be considered by the psychoacoustic modeller 230 as positive feedback from the user, although in some embodiments, this type of feedback may be given a lesser weighting in the psychoacoustic model then actual positive feedback from the user.

Figure 3:
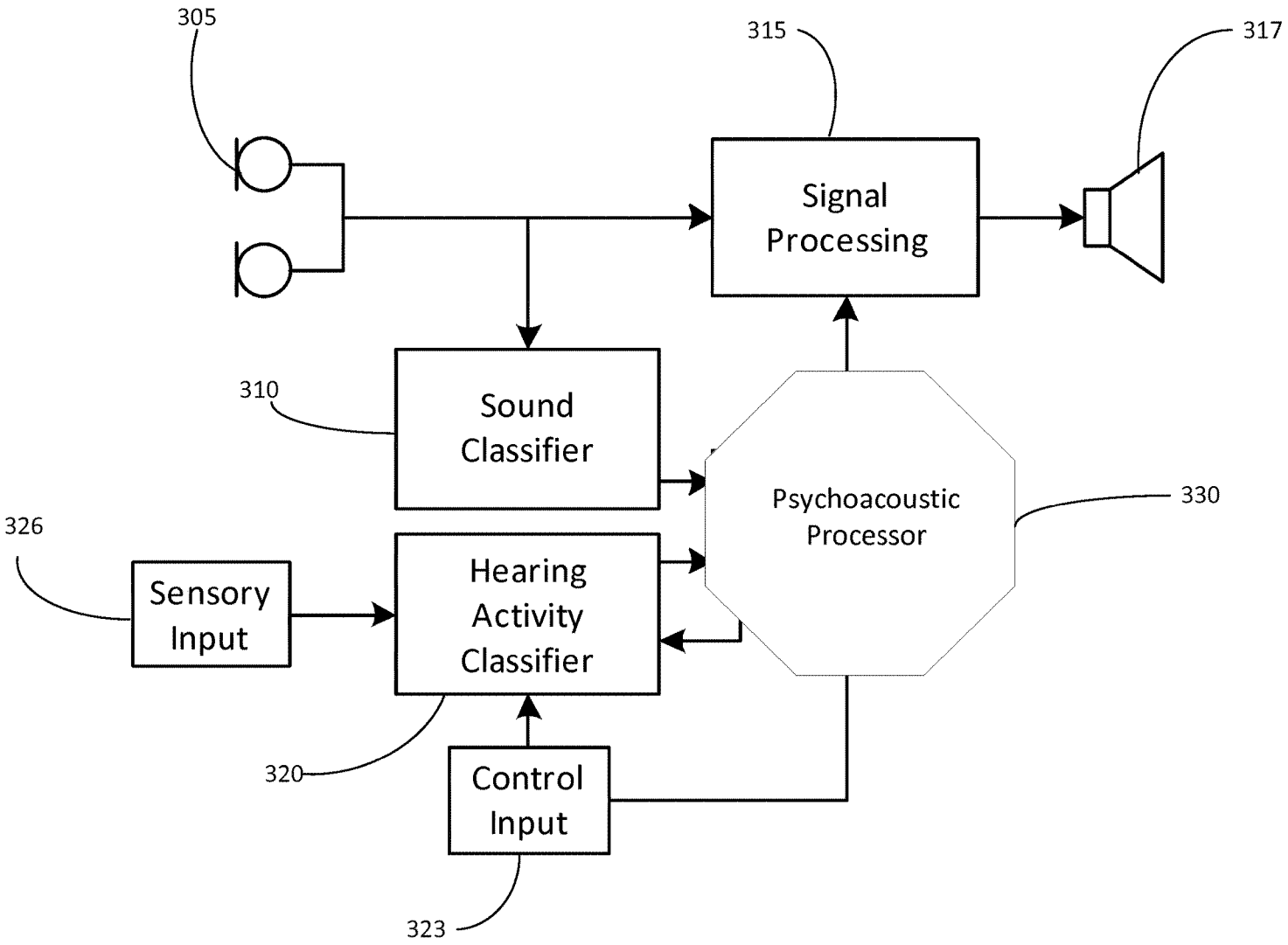
FIG. 3 illustrates a hearing activity classifier for a hearing device comprising an intelligent performance management system, in accordance with some embodiments of the present disclosure.

FIG. 3 illustrates a hearing activity classifier for a hearing device comprising an intelligent performance management system, in accordance with some embodiments of the present disclosure.

As provided herein, existing hearing devices may be configured to identify certain sound situations and provide parameter settings for the sound situation. The hearing devices, however, cannot learn user perception of hearing device operation and only consider physical criteria in adjusting hearing device settings, without considering hearing demands or hearing activities of the user. This is understandable, because it is easier to analyse objective physical factors than subjective factors, such as user perception. However, analysis of acoustic parameters is not sufficient to determine, how or what the user wants to hear.

As described herein, a psychoacoustic model may be generated for a hearing device use that may intelligently learn how or what the user wants to hear. In some embodiments of the present invention, the psychoacoustic model intelligently learns how or what the user wants to hear from, among other, things hearing activity data. Additional factors besides acoustic parameters are hearing activity. Hearing activity data may be used in the psychoacoustic model so that the hearing device can provide the user with the desired acoustic output for different activities. Merely by way of example, a user may want to be undisturbed when sitting at home reading a book, despite of noisy children outside, whereas the user, or another user, may want to listen to the children while reading to monitor them.

In some embodiments of the present disclosure, sound received by a microphone 305 of a hearing device (not shown), is communicated to a sound classifier 310. The sound classifier 310 is configured to hearing environment/sound situation communicates proposed hearing device operating parameters for the classified sound situation to a signal processor 315. The setting may comprise an "average" or a predefined setting for the sound situation. For example, the sound classifier 310 may propose an average setting that is determined from an average of previous settings for this sound situation, may be determined from response of average users to the sound situation and/or the like. The signal processor 315 may apply the settings to a speaker 317 or the like to produce an acoustic output to a hearing device user.

In some embodiments of the present disclosure, a hearing activity classifier 320 may be configured to determine a hearing activity of the hearing device user. The hearing activity classifier 320 communicates the classified hearing activity to a psychoacoustic processor 330, which may process the classification and communicate an adjustment of the sound setting for the sound situation to the signal processor 315.

Input parameters for the hearing activity classifier 320 may be provided by one or more sensors (not shown) via a sensory input 326. In some embodiments, the psychoacoustic processor 330 receives hearing activity classifications from the hearing activity classifier 320 in parallel with sound situation classifications from the sound classifier 310. This parallel inputs provides that the psychoacoustic processor 330 can process appropriate settings to communicate to the signal processor 315 for the current combination of sound situation and hearing activity. For example, the psychoacoustic processor 330 may derive appropriate settings from pattern recognition, were the pattern may be derived by means of e.g. a weighted linear or non-linear averaging, a decision tree, a look-up table, a trained neuronal network or comparable algorithms.

In some embodiments, the psychoacoustic processor 330 is able to identify patterns of both inputs from the hearing activity classifier 320 and the sound situation classifier over the course of time and to derive reaction proposals for these patterns. Identification of patterns can be done by e.g. a neuronal network or comparing with predefined patterns. In some embodiments, adjustment and learning of such reaction proposals by the psychoacoustic processor 330 may be provided from adjustment to the hearing device operation parameter made by the user via a control input 323 and/or by user perception input made in response to the hearing devices operation.

In some embodiments, the hearing device user may confirm that a hearing activity assigned to the user at that time by the hearing activity classifier 320 is correct. In this way, the hearing activity classifier can intelligently learn hearing activities as these are perceived experienced by the user. In some embodiments, the user may enter a hearing activity that the user selects as a factor for the hearing device operating parameters. For example, the user may adjust the operating parameters of the hearing device and the hearing device, either directly or through an associated device in communication with the heading device, may prompt the user to enter an activity that was a factor in the changes to the operating parameter. This provides real-time feedback of the user's perception of hearing device operation that can be communicated to the psychoacoustic processor 330.

By way of example, the user may lower the overall amplification of the hearing and may enter as a factor for this change the time of day, the location, the user's activity, such as reading, and/or the like. This input data from the user is included in a psychoacoustic model generated got the user by the psychoacoustic processor 330, and may be used to control the hearing device in accordance with the user's perception. Moreover, as discussed previously, at a later time, when the user encounters a similar/same location, time or activity, the psychoacoustic processor 330 may control the signal processor 315 to provide a similar acoustic output and then prompt the user to provide perception data, which may in some aspects be satisfied/unsatisfied perception data. In this way, the psychoacoustic processor 330 can tune/learn the user's perception preferences for different hearing activity classification and/or learn the user's perception preferences with respect to the combination of hearing environment classifications and hearing activity classification. By way of example, if the user encounters the same hearing activity classification, but is dissatisfied with the acoustic output suggested/generated by the psychoacoustic processor 330 controlling the signal processor 315, the psychoacoustic processor 330 can process differences between hearing activity classifications and intelligently learn user preferences for hearing environment classifications in combination with hearing activity classifications. The psychoacoustic processor 330 can confirm its psychoacoustic model is correct by prompting user feedback after making such changes to the acoustic output.

While the principles of the disclosure have been described above in connection with specific apparatuses and methods, it is to be clearly understood that this description is made only by way of example and not as limitation on the scope of the invention.

What is claimed is:

1. A hearing device with intelligent perception based control, comprising:

an acoustic input configured to receive an acoustic signal;

a sound analyzer configured to classify a hearing environment from the received acoustic signal;

a signal processor configured to process the received acoustic signal and the classified hearing environment and generate an audio output in an ear of a user of the hearing device;

a user parameter input configured to receive an input from the user adjusting operating parameters of the hearing device;

a user perception input configured to receive perception data from the user of the hearing device, wherein the perception data comprises the user's perception of the audio output and the user perception data is provided by the user in real-time when the user is in the hearing environment, the user perception data comprising a degree of positive user satisfaction with respect to the audio output or a degree of negative user satisfaction with respect to the audio output, the degree of positive user satisfaction or the degree of negative satisfaction determined based on a duration of the user perception input; and processing circuitry configured to generate a psychoacoustic model for the user of the hearing device from the user perception data and at least one of the classified hearing environment, the operating parameters of the hearing device, or the audio output, and wherein the signal processor is configured to process the generated psychoacoustic model to produce a customized audio output.

2. The hearing device according to claim 1, wherein the user perception input comprises at least one of a button on the hearing device and an input on an external device capable of communicating with the hearing device.

3. The hearing device according to claim 2, wherein the external device includes the processing circuitry.

4. The hearing device according to claim 2, wherein the external device comprises at least one of: a smartphone, a portable computer, a tablet, or a smart watch.

5. The hearing device according to claim 1, wherein the generated psychoacoustic model is stored on an external processor or in the cloud.

6. The hearing device according to claim 1, wherein the hearing device is configured to provide a prompt to the user to input the user perception data.

7. The hearing device according to claim 6, wherein the prompt is provided to the user after at least one of: the user using the user parameter input to adjust the operating parameters of the hearing device; the signal processor processing the generated psychoacoustic model to produce the customized audio output, or the signal processor generate the audio output for the classified hearing environment.

8. The hearing device according to claim 1, further comprising:

a sensor configured to sense a circumstance occurring at a time of operation of the hearing device in the hearing environment.

9. The hearing device according to claim 8, wherein the circumstance comprises at least one of: a time, a date, a location, a state of connectivity of the hearing device with an external device, a source of acoustic input to the hearing device, or a user activity.

10. The hearing device according to claim 9, wherein the sensor comprises at least one of: a global positioning system receiver, an accelerometer, a temperature sensor, a time and date sensor, a connectivity sensor configured to detect a connectivity state of the hearing device, a heartrate sensor, a motion sensor, an illumination sensor, a facial recognition sensor, or a sound sensor.

11. The hearing device according to claim 8, further comprising:

a hearing activity classifier configured to process the sensed circumstance to determine a hearing activity of the hearing device user.

12. The hearing device according to claim 8, wherein the processing circuitry uses the sensed circumstance to generate the psychoacoustic model.

13. The hearing device according to claim 8, wherein the sensor comprises a smartphone, an activity tracker, or a smartwatch.

14. A method for controlling operation of a hearing device for a hearing device user, comprising:

receiving an acoustic input;

using the received acoustic input to classify a hearing environment;

processing the acoustic input to adjust operating parameters of the hearing device to produce an acoustic output, wherein the processing of the acoustic output and the adjustment of the operating parameters is performed using the classified hearing environment and a hearing ability of the hearing device user;

providing the acoustic output to the hearing device user;

receiving feedback from the hearing device user regarding the hearing device user's perception of the acoustic output, the feedback comprising a degree of positive user satisfaction with respect to the acoustic output or a degree of negative user satisfaction with respect to the acoustic output, the degree of positive user satisfaction or the degree of negative satisfaction determined based on a duration of the feedback; and using the feedback, the classified hearing environment, and the acoustic output to generate a psychoacoustic model for the hearing device user.

15. The method according to claim 14, further comprising:

the user manually adjusting the operating parameters of the hearing device to change the acoustic output.

16. The method according to claim 15, wherein the manual adjustments are added to the psychoacoustic model with the classified hearing environment at a time when the manual adjustments were performed.

* * * * *